US012253347B2

(12) United States Patent
Burrow et al.

(10) Patent No.: US 12,253,347 B2
(45) Date of Patent: Mar. 18, 2025

(54) THREE-PIECE PRIMER INSERT FOR POLYMER AMMUNITION

(71) Applicant: True Velocity IP Holdings, LLC, Garland, TX (US)

(72) Inventors: Lonnie Burrow, Carrollton, TX (US); Christopher William Overton, Wylie, TX (US)

(73) Assignee: True Velocity IP Holdings, Inc., Garland, TX (US)

( * ) Notice: Subject to any disclaimer, the term of this patent is extended or adjusted under 35 U.S.C. 154(b) by 49 days.

(21) Appl. No.: 18/113,613

(22) Filed: Feb. 23, 2023

(65) Prior Publication Data

US 2023/0408234 A1 Dec. 21, 2023

Related U.S. Application Data

(63) Continuation of application No. 16/460,155, filed on Jul. 2, 2019, now Pat. No. 11,614,314.
(Continued)

(51) Int. Cl.
*F42C 19/08* (2006.01)
*F42B 5/307* (2006.01)

(52) U.S. Cl.
CPC ..... *F42C 19/083* (2013.01); *F42B 5/307* (2013.01)

(58) Field of Classification Search
CPC .... F42B 5/26; F42B 5/28; F42B 5/285; F42B 5/295; F42B 5/297; F42B 5/30;
(Continued)

(56) References Cited

U.S. PATENT DOCUMENTS 113,634 A 4/1871 Crispin
130,679 A 8/1872 Whitmore
(Continued)

*Primary Examiner* — Joshua E Freeman
*Assistant Examiner* — Benjamin S Gomberg
(74) *Attorney, Agent, or Firm* — Burdick Patents, P.A.; Sean D. Burdick; Colin L. Honan

(57) ABSTRACT

The present invention provides three piece primer insert for use in polymer ammunition comprising: an upper primer insert portion comprising an upper primer insert bottom portion, a substantially cylindrical coupling element extending away from the upper primer insert bottom portion; and an upper flash aperture that extends through the upper primer insert bottom portion, a lower primer insert portion in contact with the upper primer insert portion, wherein the lower primer insert portion comprises a lower primer insert top portion positioned adjacent to the upper primer insert bottom portion at a connection joint, a lower flash aperture positioned in the lower primer insert top portion and aligned with the upper flash aperture, and a primer recess that extends away from the lower primer insert top portion to an extraction flange and in communication with the lower flash aperture; and a connecting portion that secures the upper primer insert portion and the lower primer insert portion wherein the connecting portion comprises a connecting member positioned in the upper flash aperture and the lower flash aperture, an upper tab connected to the connecting member to extend away from the upper flash aperture into the upper primer insert portion, a lower tab connected to the connecting member to extend away from the lower flash aperture into the primer recess, and a flash hole that extends from the upper tab to the lower tab to connect the upper primer insert bottom portion to the primer recess.

19 Claims, 6 Drawing Sheets

Related U.S. Application Data

(60) Provisional application No. 62/694,868, filed on Jul. 6, 2018.

(58) Field of Classification Search
CPC .. F42B 5/307; F42B 5/313; F42B 5/36; F42B 33/00; F42B 33/001; F42B 33/02; F42C 19/08; F42C 19/0807; F42C 19/0823; F42C 19/0826; F42C 19/083; F42C 19/10
USPC ..... 102/204, 467
See application file for complete search history.

(56) References Cited

U.S. PATENT DOCUMENTS 159,665 A 2/1875 Gauthey
169,807 A 11/1875 Hart
462,611 A * 11/1891 De Sparre ..... F42B 5/26 102/469
475,008 A 5/1892 Bush et al.
498,856 A 6/1893 Overbaugh
498,857 A 6/1893 Overbaugh
1,060,817 A 5/1913 Clyne
1,060,818 A 5/1913 Clyne
1,064,907 A 6/1913 Hoagland
1,187,464 A 6/1916 Offutt
1,842,445 A 1/1932 Clyne
1,936,905 A 11/1933 Gaidos
1,940,657 A 12/1933 Woodford
2,294,822 A 9/1942 Norman
2,465,962 A 3/1949 Allen et al.
2,654,319 A 10/1953 Roske
2,823,611 A 2/1958 Thayer
2,862,446 A 12/1958 Lars
2,918,868 A 12/1959 Lars
2,936,709 A 5/1960 Seavey
2,953,990 A 9/1960 Miller
2,972,947 A 2/1961 Fitzsimmons et al.
3,034,433 A 5/1962 Karl
3,099,958 A 8/1963 Daubenspeck et al.
3,157,121 A 11/1964 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,246,603 A 4/1966 Comerford
3,256,815 A 6/1966 Davidson et al.
3,288,066 A 11/1966 Hans et al.
3,292,538 A 12/1966 Hans et al.
3,444,777 A 5/1969 Lage
3,446,146 A 5/1969 Stadler et al.
3,485,170 A 12/1969 Scanlon
3,485,173 A 12/1969 Morgan
3,491,691 A 1/1970 Vawter
3,565,008 A 2/1971 Gulley et al.
3,590,740 A 7/1971 Herter
3,609,904 A 10/1971 Scanlon
3,614,929 A 10/1971 Herter et al.
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,786,755 A 1/1974 Eckstein et al.
3,797,396 A 3/1974 Reed
3,842,739 A * 10/1974 Scanlon ..... F42B 5/073 102/467
3,866,536 A 2/1975 Greenberg
3,874,294 A 4/1975 Hale
3,955,506 A 5/1976 Luther et al.
3,977,326 A * 8/1976 Anderson ..... F42B 5/307 102/467
3,990,366 A * 11/1976 Scanlon ..... F42B 5/26 102/467
4,005,630 A 2/1977 Patrick
4,020,763 A 5/1977 Iruretagoyena
4,132,173 A 1/1979 Amuchastegui
4,147,107 A * 4/1979 Ringdal ..... F42B 5/307 102/467
4,157,684 A 6/1979 Clausser
4,173,186 A 11/1979 Dunham
4,179,992 A 12/1979 Ramnarace et al.
4,187,271 A 2/1980 Rolston et al.
4,228,724 A 10/1980 Leich
4,276,830 A 7/1981 Alice
4,353,304 A 10/1982 Hubsch et al.
4,475,435 A 10/1984 Mantel
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,763,576 A 8/1988 Kass et al.
4,867,065 A 9/1989 Kaltmann et al.
4,970,959 A 11/1990 Bilsbury et al.
5,021,206 A 6/1991 Stoops
5,033,386 A 7/1991 Vatsvog
5,063,853 A * 11/1991 Bilgeri ..... F42B 5/307 102/467
5,090,327 A 2/1992 Bilgeri
5,127,331 A 7/1992 Stoops
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
5,433,148 A 7/1995 Barratault et al.
5,535,495 A 7/1996 Gutowski
5,563,365 A 10/1996 Dineen et al.
5,616,642 A 4/1997 West et al.
5,679,920 A 10/1997 Hallis et al.
5,758,445 A 6/1998 Casull
5,770,815 A 6/1998 Watson, Jr.
5,798,478 A 8/1998 Beal
5,950,063 A 9/1999 Hens et al.
5,961,200 A 10/1999 Friis
5,969,288 A 10/1999 Baud
5,979,331 A * 11/1999 Casull ..... F41A 15/12 102/470
6,004,682 A 12/1999 Rackovan et al.
6,048,379 A 4/2000 Bray et al.
6,070,532 A 6/2000 Halverson
6,257,148 B1 7/2001 Toivonen et al.
7,750,091 B2 7/2010 Maljkovic et al.
7,841,279 B2 11/2010 Reynolds et al.
7,930,977 B2 4/2011 Klein
8,007,370 B2 8/2011 Hirsch et al.
8,056,232 B2 11/2011 Patel et al.
8,156,870 B2 * 4/2012 South ..... F42B 5/30 102/464
8,186,273 B2 5/2012 Trivette
8,201,867 B2 6/2012 Thomeczek
8,206,522 B2 6/2012 Sandstrom et al.
8,240,252 B2 8/2012 Maljkovic et al.
8,408,137 B2 4/2013 Battaglia
8,443,729 B2 5/2013 Mittelstaedt
8,443,730 B2 5/2013 Padgett
8,511,233 B2 8/2013 Nilsson
8,522,684 B2 9/2013 Davies et al.
8,540,828 B2 9/2013 Busky et al.
8,561,543 B2 10/2013 Burrow
8,573,126 B2 11/2013 Klein et al.
9,551,557 B1 * 1/2017 Burrow ..... F42B 5/30
9,599,443 B2 * 3/2017 Padgett ..... F42C 19/083
10,041,770 B2 8/2018 Burrow
10,041,771 B1 8/2018 Burrow
10,041,776 B1 8/2018 Burrow
10,041,777 B1 8/2018 Burrow
10,048,049 B2 8/2018 Burrow

(56) References Cited

U.S. PATENT DOCUMENTS 10,048,050 B1 8/2018 Burrow
10,048,052 B2 8/2018 Burrow
10,054,413 B1 8/2018 Burrow
10,081,057 B2 9/2018 Burrow
10,101,140 B2 10/2018 Burrow
10,124,343 B2 11/2018 Tsai
10,145,662 B2 12/2018 Burrow
10,190,857 B2 1/2019 Burrow
10,234,249 B2 3/2019 Burrow
10,234,253 B2 3/2019 Burrow
10,240,905 B2 3/2019 Burrow
10,254,096 B2 4/2019 Burrow
10,260,847 B2 4/2019 Viggiano et al.
10,302,403 B2 5/2019 Burrow
10,302,404 B2 5/2019 Burrow
10,345,088 B2 7/2019 Burrow
10,352,664 B2 7/2019 Burrow
10,352,670 B2 7/2019 Burrow
10,359,262 B2 7/2019 Burrow
10,365,074 B2 7/2019 Burrow et al.
10,408,582 B2 9/2019 Burrow
10,408,592 B2 9/2019 Boss et al.
10,415,943 B2 9/2019 Burrow
10,429,156 B2 10/2019 Burrow
10,480,912 B2 11/2019 Burrow
10,480,915 B2 11/2019 Burrow
10,488,165 B2 11/2019 Burrow
10,533,830 B2 1/2020 Burrow et al.
10,571,162 B2 2/2020 Makansi et al.
10,571,228 B2 2/2020 Burrow
10,571,229 B2 2/2020 Burrow
10,571,230 B2 2/2020 Burrow
10,571,231 B2 2/2020 Burrow
10,578,409 B2 3/2020 Burrow
10,591,260 B2 3/2020 Burrow
10,612,897 B2 4/2020 Burrow et al.
10,704,877 B2 7/2020 Boss et al.
10,731,957 B1 8/2020 Burrow et al.
10,845,169 B2 11/2020 Burrow
10,914,558 B2 2/2021 Burrow
10,948,272 B1 3/2021 Drobockyi et al.
10,976,144 B1 4/2021 Peterson et al.
10,996,029 B2 5/2021 Burrow
10,996,030 B2 5/2021 Burrow
11,112,224 B2 9/2021 Burrow et al.
11,112,225 B2 9/2021 Burrow et al.
11,118,875 B1 9/2021 Burrow
11,118,876 B2 9/2021 Burrow et al.
11,118,877 B2 9/2021 Burrow et al.
11,118,882 B2 9/2021 Burrow
11,125,540 B2 9/2021 Pennell et al.
11,199,384 B2 12/2021 Koh et al.
11,209,251 B2 12/2021 Burrow et al.
11,209,252 B2 12/2021 Burrow
11,209,256 B2 12/2021 Burrow et al.
11,215,430 B2 1/2022 Boss et al.
11,226,179 B2 1/2022 Burrow
11,231,257 B2 1/2022 Burrow
11,231,258 B2 1/2022 Burrow
11,243,059 B2 2/2022 Burrow
11,243,060 B2 2/2022 Burrow
11,248,885 B2 2/2022 Burrow
11,248,886 B2 2/2022 Burrow et al.
11,255,647 B2 2/2022 Burrow
11,255,649 B2 2/2022 Burrow
2003/0127011 A1 7/2003 Mackerell et al.
2004/0074412 A1 4/2004 Kightlinger
2004/0200340 A1 10/2004 Robinson et al.
2005/0056183 A1 3/2005 Meshirer
2005/0081704 A1 4/2005 Husseini
2005/0257712 A1 11/2005 Husseini et al.
2006/0027125 A1 2/2006 Brunn
2006/0278116 A1 12/2006 Hunt
2006/0283345 A1 12/2006 Feldman et al.
2007/0056343 A1 3/2007 Cremonesi
2007/0181029 A1 8/2007 Mcaninch
2007/0214992 A1 9/2007 Dittrich
2007/0214993 A1 9/2007 Cerovic et al.
2007/0267587 A1 11/2007 Dalluge
2010/0101444 A1 4/2010 Schluckebier et al.
2010/0212533 A1 8/2010 Brunn
2010/0234132 A1 9/2010 Hirsch et al.
2010/0258023 A1 10/2010 Reynolds et al.
2010/0282112 A1 11/2010 Battaglia
2011/0179965 A1 7/2011 Mason
2012/0024183 A1 2/2012 Klein
2012/0060716 A1 3/2012 Davies et al.
2012/0111219 A1 5/2012 Burrow
2012/0180685 A1 7/2012 Se-Hong
2012/0180687 A1 7/2012 Padgett et al.
2012/0291655 A1 11/2012 Jones
2013/0008335 A1 1/2013 Menefee, III
2013/0014664 A1 1/2013 Padgett
2013/0076865 A1 3/2013 Tateno et al.
2013/0186294 A1 7/2013 Davies et al.
2013/0291711 A1 11/2013 Mason
2014/0224144 A1* 8/2014 Neugebauer ..... F42B 5/26 102/470
2014/0260925 A1 9/2014 Beach et al.
2014/0261044 A1 9/2014 Seecamp
2014/0311332 A1 10/2014 Carlson et al.
2015/0075400 A1 3/2015 Lemke et al.
2015/0226220 A1 8/2015 Bevington
2015/0268020 A1 9/2015 Emary
2016/0003585 A1 1/2016 Carpenter et al.
2016/0003589 A1 1/2016 Burrow
2016/0003590 A1 1/2016 Burrow
2016/0003593 A1 1/2016 Burrow
2016/0003594 A1 1/2016 Burrow
2016/0003595 A1 1/2016 Burrow
2016/0003596 A1 1/2016 Burrow
2016/0003597 A1 1/2016 Burrow
2016/0003601 A1 1/2016 Burrow
2016/0033241 A1 2/2016 Burrow
2016/0102030 A1 4/2016 Coffey et al.
2016/0146585 A1 5/2016 Padgett
2016/0245626 A1 8/2016 Drieling et al.
2016/0265886 A1 9/2016 Aldrich et al.
2016/0349022 A1 12/2016 Burrow
2016/0349023 A1 12/2016 Burrow
2016/0349028 A1 12/2016 Burrow
2016/0356588 A1 12/2016 Burrow
2016/0377399 A1 12/2016 Burrow
2017/0030690 A1* 2/2017 Viggiano ..... F42B 33/001
2017/0030692 A1 2/2017 Drobockyi et al.
2017/0080498 A1 3/2017 Burrow
2017/0082409 A1 3/2017 Burrow
2017/0082411 A1 3/2017 Burrow
2017/0089673 A1 3/2017 Burrow
2017/0089674 A1 3/2017 Burrow
2017/0089675 A1 3/2017 Burrow
2017/0089679 A1 3/2017 Burrow
2017/0115105 A1 4/2017 Burrow
2017/0153093 A9 6/2017 Burrow
2017/0153099 A9 6/2017 Burrow
2017/0191812 A1 7/2017 Padgett et al.
2017/0199018 A9 7/2017 Burrow
2017/0205217 A9 7/2017 Burrow
2017/0261296 A1 9/2017 Burrow
2017/0299352 A9 10/2017 Burrow
2018/0066925 A1 3/2018 Skowron et al.
2018/0106581 A1 4/2018 Rogers
2018/0224252 A1 8/2018 O'Rourke
2018/0224253 A1 8/2018 Burrow
2018/0224256 A1 8/2018 Burrow
2018/0259310 A1 9/2018 Burrow
2018/0292186 A1 10/2018 Padgett et al.
2018/0306558 A1 10/2018 Padgett et al.
2019/0011233 A1 1/2019 Boss et al.
2019/0011234 A1 1/2019 Boss et al.
2019/0011235 A1 1/2019 Boss et al.
2019/0011237 A1 1/2019 Burrow
2019/0011238 A1 1/2019 Burrow
2019/0011239 A1 1/2019 Burrow

(56) References Cited

U.S. PATENT DOCUMENTS

2019/0011240 A1 1/2019 Burrow
2019/0011241 A1 1/2019 Burrow
2019/0025019 A1 1/2019 Burrow
2019/0025020 A1 1/2019 Burrow
2019/0025021 A1 1/2019 Burrow
2019/0025022 A1 1/2019 Burrow
2019/0025023 A1 1/2019 Burrow
2019/0025024 A1 1/2019 Burrow
2019/0025025 A1 1/2019 Burrow
2019/0025026 A1 1/2019 Burrow
2019/0025035 A1 1/2019 Burrow
2019/0025036 A1 1/2019 Burrow
2019/0078862 A1 3/2019 Burrow
2019/0106364 A1 4/2019 James
2019/0107375 A1 4/2019 Burrow
2019/0137228 A1 5/2019 Burrow et al.
2019/0137229 A1 5/2019 Burrow et al.
2019/0137230 A1 5/2019 Burrow et al.
2019/0137231 A1 5/2019 Burrow et al.
2019/0137232 A1 5/2019 Burrow et al.
2019/0137233 A1 5/2019 Burrow et al.
2019/0137234 A1 5/2019 Burrow et al.
2019/0137235 A1 5/2019 Burrow et al.
2019/0137236 A1 5/2019 Burrow et al.
2019/0137237 A1 5/2019 Burrow et al.
2019/0137238 A1 5/2019 Burrow et al.
2019/0137239 A1 5/2019 Burrow et al.
2019/0137240 A1 5/2019 Burrow et al.
2019/0137241 A1 5/2019 Burrow et al.
2019/0137242 A1 5/2019 Burrow et al.
2019/0137243 A1 5/2019 Burrow et al.
2019/0137244 A1 5/2019 Burrow et al.
2019/0170488 A1 6/2019 Burrow
2019/0204050 A1 7/2019 Burrow
2019/0204056 A1 7/2019 Burrow
2019/0212117 A1 7/2019 Burrow
2019/0242679 A1 8/2019 Viggiano et al.
2019/0242682 A1 8/2019 Burrow
2019/0242683 A1 8/2019 Burrow
2019/0249967 A1 8/2019 Burrow et al.
2019/0257625 A1 8/2019 Burrow
2019/0310058 A1 10/2019 Burrow
2019/0310059 A1 10/2019 Burrow
2019/0316886 A1 10/2019 Burrow
2019/0360788 A1 11/2019 Burrow
2019/0376773 A1 12/2019 Burrow
2019/0376774 A1 12/2019 Boss et al.
2019/0383590 A1 12/2019 Burrow
2019/0390929 A1 12/2019 Libotte
2020/0011645 A1 1/2020 Burrow et al.
2020/0011646 A1 1/2020 Burrow et al.
2020/0025536 A1 1/2020 Burrow et al.
2020/0025537 A1 1/2020 Burrow et al.
2020/0033102 A1 1/2020 Burrow
2020/0033103 A1 1/2020 Burrow et al.
2020/0041239 A1 2/2020 Burrow
2020/0049469 A1 2/2020 Burrow
2020/0049470 A1 2/2020 Burrow
2020/0049471 A1 2/2020 Burrow
2020/0049472 A1 2/2020 Burrow
2020/0049473 A1 2/2020 Burrow
2020/0056872 A1 2/2020 Burrow
2020/0109932 A1 4/2020 Burrow
2020/0149853 A1 5/2020 Burrow
2020/0158483 A1 5/2020 Burrow
2020/0200512 A1 6/2020 Burrow
2020/0208948 A1 7/2020 Burrow
2020/0208950 A1 7/2020 Burrow
2020/0248999 A1 8/2020 Burrow
2020/0256654 A1 8/2020 Burrow
2020/0263962 A1 8/2020 Burrow et al.
2020/0278183 A1 9/2020 Burrow et al.
2020/0300587 A1 9/2020 Burrow et al.
2020/0318937 A1 10/2020 Skowron et al.
2020/0363172 A1 11/2020 Koh et al.
2020/0393220 A1 12/2020 Burrow
2020/0400411 A9 12/2020 Burrow
2021/0003373 A1 1/2021 Burrow
2021/0041211 A1 2/2021 Pennell et al.
2021/0041212 A1 2/2021 Burrow et al.
2021/0041213 A1 2/2021 Padgett
2021/0072006 A1 3/2021 Padgett et al.
2021/0080236 A1 3/2021 Burrow
2021/0080237 A1 3/2021 Burrow et al.
2021/0108898 A1 4/2021 Overton et al.
2021/0108899 A1 4/2021 Burrow et al.
2021/0123709 A1 4/2021 Burrow et al.
2021/0131772 A1 5/2021 Burrow
2021/0131773 A1 5/2021 Burrow
2021/0131774 A1 5/2021 Burrow
2021/0140749 A1 5/2021 Burrow
2021/0148682 A1 5/2021 Burrow
2021/0223017 A1 7/2021 Peterson et al.
2021/0270579 A1 9/2021 Burrow
2021/0270580 A1 9/2021 Burrow
2021/0270581 A1 9/2021 Burrow
2021/0270582 A1 9/2021 Burrow
2021/0270588 A1 9/2021 Burrow et al.
2021/0278179 A1 9/2021 Burrow et al.
2021/0301134 A1 9/2021 Yu et al.
2021/0302136 A1 9/2021 Burrow
2021/0302137 A1 9/2021 Burrow
2021/0325156 A1 10/2021 Burrow
2021/0325157 A1 10/2021 Burrow
2021/0333073 A1 10/2021 Burrow et al.
2021/0333075 A1 10/2021 Burrow
2021/0341266 A1 11/2021 Burrow
2021/0341267 A1 11/2021 Burrow
2021/0341268 A1 11/2021 Burrow
2021/0341269 A1 11/2021 Burrow
2021/0341270 A1 11/2021 Burrow
2021/0341271 A1 11/2021 Burrow
2021/0341272 A1 11/2021 Burrow
2021/0341273 A1 11/2021 Burrow
2021/0348892 A1 11/2021 Burrow
2021/0348893 A1 11/2021 Burrow
2021/0348894 A1 11/2021 Burrow
2021/0348895 A1 11/2021 Burrow
2021/0348902 A1 11/2021 Burrow
2021/0348903 A1 11/2021 Burrow
2021/0348904 A1 11/2021 Burrow
2021/0364257 A1 11/2021 Burrow et al.
2021/0364258 A1 11/2021 Burrow et al.
2021/0372747 A1 12/2021 Burrow
2021/0372748 A1 12/2021 Burrow et al.
2021/0372749 A1 12/2021 Burrow et al.
2021/0372750 A1 12/2021 Burrow et al.
2021/0372751 A1 12/2021 Burrow et al.
2021/0372754 A1 12/2021 Burrow
2021/0381813 A1 12/2021 Burrow
2021/0389106 A1 12/2021 Burrow
2022/0011083 A1 1/2022 Burrow
2022/0018639 A1 1/2022 Burrow
2022/0018640 A1 1/2022 Burrow et al.
2022/0018641 A1 1/2022 Burrow
2022/0034639 A1 2/2022 Burrow
2022/0049938 A1 2/2022 Burrow et al.
2022/0065594 A1 3/2022 Burrow
2022/0074721 A1 3/2022 Burrow
2022/0074724 A1 3/2022 Burrow et al.
2022/0082359 A1 3/2022 Boss et al.
2022/0082360 A1 3/2022 Burrow

* cited by examiner

THREE-PIECE PRIMER INSERT FOR POLYMER AMMUNITION

CROSS-REFERENCE TO RELATED APPLICATIONS

This application is a continuation of and claims priority to U.S. patent application Ser. No. 16/460,155, filed Jul. 2, 2019, which claims the benefit of U.S. Provisional Patent Application No. 62/694,868, filed Jul. 6, 2018, both of which are incorporated herein by reference.

TECHNICAL FIELD OF THE INVENTION

The present invention relates in general to the field of ammunition, specifically to compositions and methods of making polymer ammunition having a primer inserts made by joining 3 or more portions.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacturing requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

For example, U.S. patent application Ser. No. 11/160,682 discloses a base for a cartridge casing body for an ammunition article, the base having an ignition device; an attachment device at one end thereof, the attachment device being adapted to the base to a cartridge casing body; wherein the base is made from plastic, ceramic, or a composite material.

U.S. Pat. No. 7,610,858 discloses an ammunition cartridge assembled from a substantially cylindrical polymeric cartridge casing body; and a cylindrical polymeric middle body component with opposing first and second ends, wherein the first end has a coupling element that is a mate for the projectile-end coupling element and joins the first end of the middle body component to the second end of the bullet-end component, and the second end is the end of the casing body opposite the projectile end and has a male or female coupling element; and a cylindrical cartridge casing head-end component with an essentially closed base end with a primer hole opposite an open end with a coupling element that is a mate for the coupling element on the second end of the middle body and joins the second end of the middle body component to the open end of the head-end component.

Shortcomings of the known methods of producing plastic or substantially plastic ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

BRIEF SUMMARY OF THE INVENTION

The present invention provides three piece primer insert for use in polymer ammunition comprising: an upper primer insert portion comprising an upper primer insert bottom portion, a substantially cylindrical coupling element extending away from the upper primer insert bottom portion; and an upper flash aperture that extends through the upper primer insert bottom portion, a lower primer insert portion in contact with the upper primer insert portion, wherein the lower primer insert portion comprises a lower primer insert top portion positioned adjacent to the upper primer insert bottom portion at a connection joint, a lower flash aperture positioned in the lower primer insert top portion and aligned with the upper flash aperture, and a primer recess that extends away from the lower primer insert top portion to an extraction flange and in communication with the lower flash aperture; and a connecting portion that secures the upper primer insert portion and the lower primer insert portion wherein the connecting portion comprises a connecting member positioned in the upper flash aperture and the lower flash aperture, an upper tab connected to the connecting member to extend away from the upper flash aperture into the upper primer insert portion, a lower tab connected to the connecting member to extend away from the lower flash aperture into the primer recess, and a flash hole that extends from the upper tab to the lower tab to connect the upper primer insert bottom portion to the primer recess.

The three piece primer insert may include a channel between the upper tab and the upper primer insert bottom portion. The upper primer insert portion, the lower primer insert portion, the connecting portion or a combination thereof are formed independently by metal injection molding, polymer injection molding, stamping, milling, molding, machining, punching, fine blanking, smelting, or any other method that will form insert portions that may be joined together to form a primer insert. The upper tab and the lower tab are independently locked, friction fitted, coined, snap fitted, chemical bonded, adhesive bonded, chemical welded, soldered, smelted, fused, melted, sintered, laser welded, ultrasonic welded, friction spot welded, or friction stir welded to secure the upper primer insert portion to the lower primer insert portion.

The present invention provides a method of making a three piece primer insert for use in polymer ammunition comprising: forming an upper primer insert portion comprising an upper primer insert bottom portion, a substantially cylindrical coupling element 18 extending away from the upper primer insert bottom portion; and an upper flash aperture that extends through the upper primer insert bottom portion, forming an a lower primer insert portion in contact with the upper primer insert portion, wherein the lower primer insert portion comprises a lower primer insert top portion positioned adjacent to the upper primer insert bottom portion at a connection joint, a lower flash aperture positioned in the lower primer insert top portion and aligned with the upper flash aperture, and a primer recess that extends away from the lower primer insert top portion to an extraction flange and in communication with the lower flash aperture; aligning the upper primer insert portion and the lower primer insert portion such that the upper flash aperture is aligned with the with the lower flash aperture; forming a connecting portion comprising a connecting member adapted to fit in the upper flash aperture and the lower flash aperture, an upper tab connected to the connecting member to extend away from the upper flash aperture, a lower tab connected to the connecting member to extend away from the lower flash aperture; positioning the connecting member into the upper flash aperture and the lower flash aperture, positioning the upper tab over at least a portion of the upper primer insert portion, positioning the lower tab over at least a portion of the lower flash aperture to secure the upper primer insert portion and the lower primer insert portion and form a flash hole; a connecting portion that secures the upper primer insert portion and the lower primer insert portion wherein the connecting portion comprises a connecting member positioned in the upper flash aperture and the lower flash aperture, an upper tab connected to the connecting member to extend away from the upper flash aperture into the upper primer insert portion, a lower tab connected to the connecting member to extend away from the lower flash aperture into the primer recess, and a flash hole that extends from the upper tab to the lower tab to connect the upper primer insert bottom portion to the primer recess.

The present invention provides a polymer ammunition cartridge comprising: a three piece primer insert comprising: an upper primer insert portion 12 comprising an upper primer insert bottom portion 20, a substantially cylindrical coupling element 18 extending away from the upper primer insert bottom portion 20; and an upper flash aperture 24 that extends through the upper primer insert bottom portion 20, a lower primer insert portion 14 in contact with the upper primer insert portion 12, wherein the lower primer insert portion 14 comprises a lower primer insert top portion positioned adjacent to the upper primer insert bottom portion 20 at a connection joint 34, a lower flash aperture 32 positioned in the lower primer insert top portion and aligned with the upper flash aperture 24, and a primer recess 44 that extends away from the lower primer insert top portion to an extraction flange 26 and in communication with the lower flash aperture 32; and a connecting portion 16 that secures the upper primer insert portion 12 and the lower primer insert portion 14 wherein the connecting portion 16 comprises a connecting member 40 positioned in the upper flash aperture 24 and the lower flash aperture 32, an upper tab 36 connected to the connecting member 40 to extend away from the upper flash aperture 24 into the upper primer insert portion 12, a lower tab 38 connected to the connecting member 40 to extend away from the lower flash aperture 32 into the primer recess 44, and a flash hole that extends from the upper tab 36 to the lower tab 38 to connect the upper primer insert bottom portion 20 to the primer recess 44; a substantially cylindrical polymeric middle body extending about the three piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; and a substantially cylindrical polymeric bullet-end upper portion comprising a bullet-end coupling element connected to the substantially cylindrical polymeric bullet-end coupling element opposite a projectile aperture adapted to engage a bullet.

The present invention provides a polymeric ammunition comprising: a three piece primer insert comprising: an upper primer insert portion 12 comprising an upper primer insert bottom portion 20, a substantially cylindrical coupling element 18 extending away from the upper primer insert bottom portion 20; and an upper flash aperture 24 that extends through the upper primer insert bottom portion 20, a lower primer insert portion 14 in contact with the upper primer insert portion 12, wherein the lower primer insert portion 14 comprises a lower primer insert top portion positioned adjacent to the upper primer insert bottom portion 20 at a connection joint 34, a lower flash aperture 32 positioned in the lower primer insert top portion and aligned with the upper flash aperture 24, and a primer recess 44 that extends away from the lower primer insert top portion to an extraction flange 26 and in communication with the lower flash aperture 32; and a connecting portion 16 that secures the upper primer insert portion 12 and the lower primer insert portion 14 wherein the connecting portion 16 comprises a connecting member 40 positioned in the upper flash aperture 24 and the lower flash aperture 32, an upper tab 36 connected to the connecting member 40 to extend away from the upper flash aperture 24 into the upper primer insert portion 12, a lower tab 38 connected to the connecting member 40 to extend away from the lower flash aperture 32 into the primer recess 44, and a flash hole that extends from the upper tab 36 to the lower tab 38 to connect the upper primer insert bottom portion 20 to the primer recess 44; a substantially cylindrical polymeric middle body extending about the three piece primer insert, wherein the substantially cylindrical polymeric middle body comprises: a substantially cylindrical polymeric bullet-end coupling element at a first end of the substantially cylindrical polymeric middle body opposite a substantially cylindrical polymeric coupling end connected by a powder chamber, wherein the substantially cylindrical polymeric coupling end extends over the substantially cylindrical coupling element and covers an circumferential surface of the primer flash hole aperture; a substantially cylindrical polymeric bullet-end upper portion comprising a bullet-end coupling element connected to the substantially cylindrical polymeric bullet-end coupling element opposite a projectile aperture adapted to engage a bullet; a propellant at least partially filling the powder chamber; a primer inserted into the primer recess; and a bullet frictionally fitted in the bullet-end aperture. The polymeric ammunition cartridge has a caliber selected from .223, .243, .25-06, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The polymeric ammunition cartridge has a caliber selected from .308, .338, 50 caliber, 5.56 mm, 7.62 mm, or 12.7 mm. The substantially cylindrical polymeric middle body is formed from a ductile polymer, a nylon polymer or a fiber-reinforced polymeric composite. The substantially cylindrical polymeric bullet-end upper portion comprises a ductile polymer, a nylon polymer or a fiber-reinforced polymeric composite. The substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers. The substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
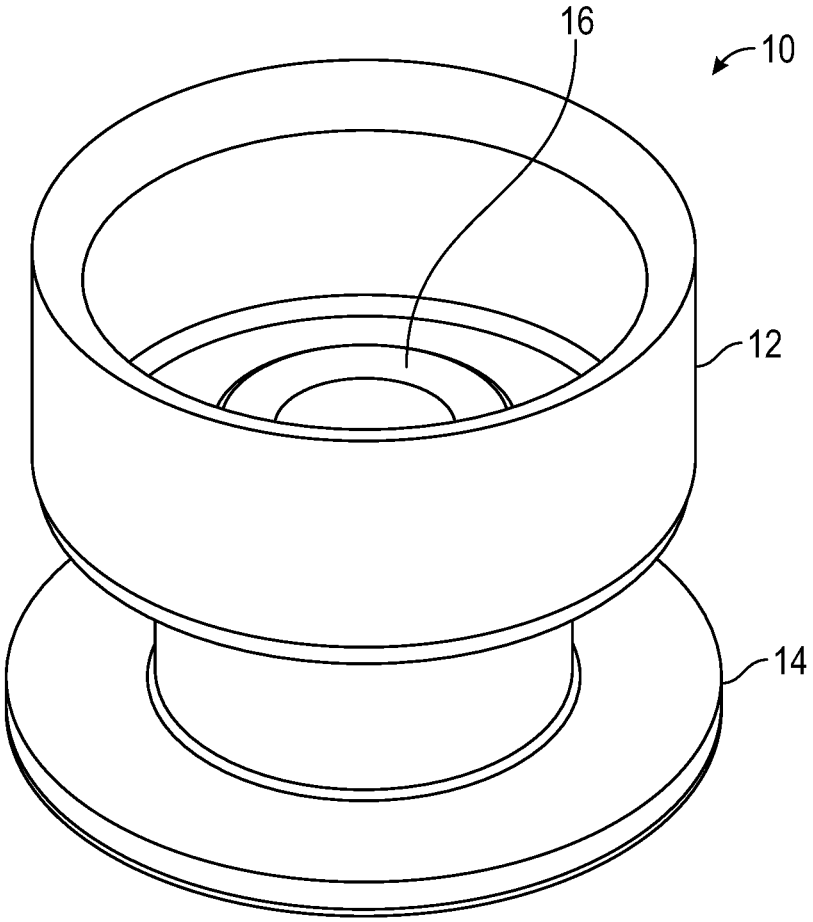
FIG. 1 depicts a prospective view of a three piece primer insert used in a polymeric cartridge case.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing. A third method does not crimp the casing end but rather the bullet is fitted into the casing and secured with adhesive.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.56 mm, 7.62 mm, .308, .338, .3030, .3006, and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The projectile and the corresponding cartridge may be of any desired size, e.g., .223, .243, .25-06, .270, .277, .300, .308, .338, .30-30, .30-06, .45-70 or .50-90, 50 caliber, 45 caliber, 380 caliber or 38 caliber, 5.56 mm, 6 mm, 6.5 mm, 6.8 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch. The cartridges, therefore, are of a caliber between about 0.05 and about 8 inches. Thus, the present invention is also applicable to the sporting goods industry for use by hunters and target shooters.

The present invention includes primer inserts that are made as a multi-piece insert. In one embodiment the multi-piece insert is a 3 piece insert but may be a 4, 5, or 6 piece insert. Regardless of the number of pieces the multi-piece insert each piece may be of similar or dissimilar materials that are connected to form a unitary primer insert. The portions of the primer insert may be constructed from dissimilar materials including metal-to-metal, polymer-to-polymer and metal-to-polymer joints. The individual pieces may be joined using various methods including smelting, sintering, adhesive bonding, welding techniques that joining dissimilar materials, including laser welding, ultrasonic welding, frictionally fitted, crimped, clamped, friction spot welding, and friction stir welding. The method of connecting the individual pieces to form a unitary insert will depend on the materials being joined. For example, a metal insert may be constructed from 2 or more metal pieces with similar melting points, strengths or hardness are joined together to form a unitary insert. Another example, an insert may be constructed from 2 or more polymers with similar melting points, strengths or hardness are joined together to form a unitary insert. Still another example, an insert may be constructed from 1 or more polymers with similar melting points, strengths or hardness joined to 1 or more metal pieces with similar melting points, strengths or hardness joined to form a unitary insert. The pieces may be joined by a friction fitting, pressing one piece into another, welding the pieces together, an adhesive may be used to join the pieces, the pieces may be melted together, a joining material may be used to connect the pieces together, sintering may be used, or any other joining mechanism known to the skilled artisan may be used to join the pieces. The pices may be crimped together using the connecting member.

The substantially cylindrical primer insert includes at least an upper primer insert portion having an upper aperture and a lower primer insert portion having a lower aperture aligned such that the upper aperture is aligned with the lower aperture and form an insert joint and are connected by a connecting member that is positioned through the upper aperture and through the lower aperture to hold the upper primer insert portion to the lower primer insert portion as a unitary substantially cylindrical primer insert. In some embodiments, the connecting member is crimped over the upper primer insert portion and the lower primer insert portion to form a unitary insert. Although it is discussed as a three piece insert however the insert may be made from 3, 4, 5, 6, 7, 8, 9, 10 or more individual pieces or combined/fused pieces together to form a unitary primer insert.

The upper primer insert portion includes an upper aperture that passes through the bottom of the upper primer insert portion. The diameter of the upper aperture may be of any convenient diameter that meets the specific requirements. The lower primer insert portion includes a lower aperture that passes through the top of the bottom primer insert portion from a primer chamber. In some embodiments, the lower aperture may have the same diameter as the upper aperture; however the upper primer insert portion may have an aperture larger diameter than the lower primer insert portion aperture or the upper primer insert portion aperture may have a diameter less that the diameter of the lower primer insert portion aperture. Generally, the diameter of the upper aperture and/or the lower aperture are similar in size and of any convenient diameter that meets the specific requirements. A connecting member having a central aperture that forms a flash hole positioned through the upper aperture and/or the lower aperture to joint the upper primer insert portion and the lower primer insert portion. In embodiments that include a spacer/joining ring, the spacer/joining ring aperture the spacer/joining aperture is the same diameter as the upper aperture and/or the lower aperture. However, that need not be the case as the spacer/joining ring aperture may be larger or smaller that the upper aperture and/or the lower aperture. In some embodiments the insert spacer is larger than the upper aperture but smaller than the lower aperture. Although, the embodiments are discussed in terms of a multi-piece design, it is understood that the three piece design may include 4, 5 6 or more pieces. Regardless of the number of section each portion may individually be made from a single material that is milled, stamped, pressed, forged, machined, molded, metal injection molded, cast or other methods. The method or construction of one portion has no bearing on the method or construction of any other portions, e.g., one may be MIM the other milled or stamped; or all may be milled, or all may be MIM, etc.

FIG. 1 depicts a prospective view of a three piece primer insert used in a polymeric cartridge case. The three piece primer insert 10 includes an upper primer portion 12 and a lower primer portion 14 connected by a connecting member 16.

Figure 2:
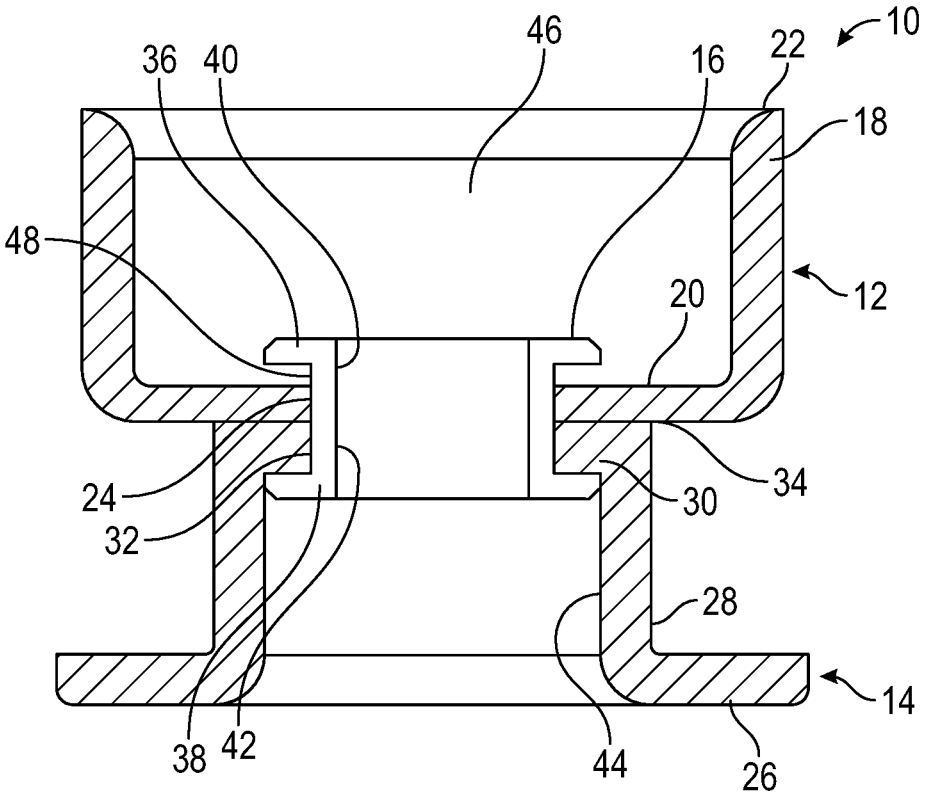
FIG. 2 depicts a side cross-sectional view of the three-piece primer insert used in polymer ammunition cases.

FIG. 2 depict a side, cross-sectional view of a three piece primer insert used in a polymeric cartridge case. The three piece primer insert 10 has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion 20 extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When over-molded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36.

Figure 3:
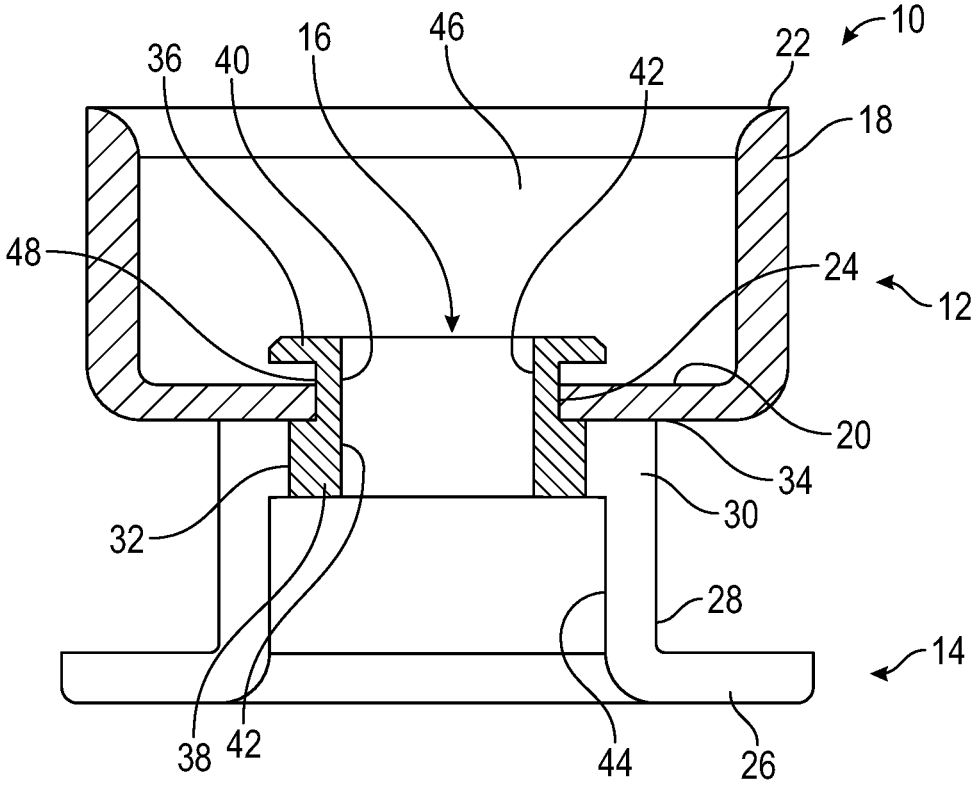
FIG. 3 depicts a side cross-sectional view of the three-piece primer insert used in polymer ammunition cases.

FIG. 3 depict a side, cross-sectional view of another embodiment of a three piece primer insert used in a polymeric cartridge case. The three piece primer insert 10 has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When over-molded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36.

Figure 4:
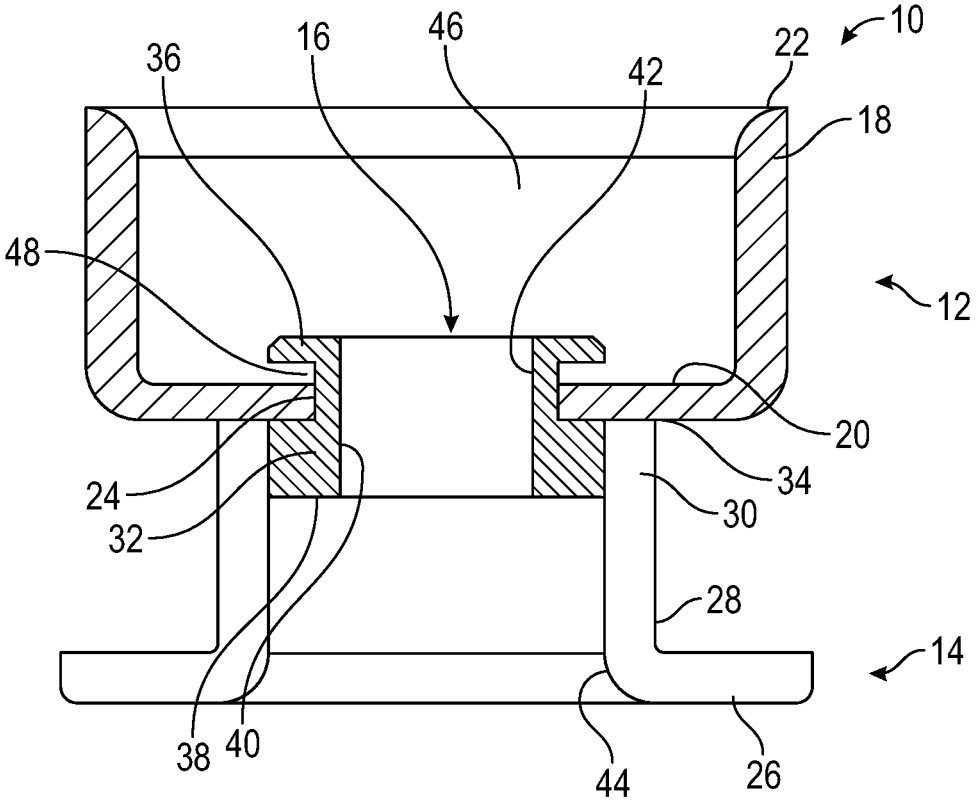
FIG. 4 depicts a side cross-sectional view of the three-piece primer insert used in polymer ammunition cases.

FIG. 4 depict a side, cross-sectional view of another embodiment of a three piece primer insert used in a polymeric cartridge case. The three piece primer insert 10 has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When over-molded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36.

Figure 5:
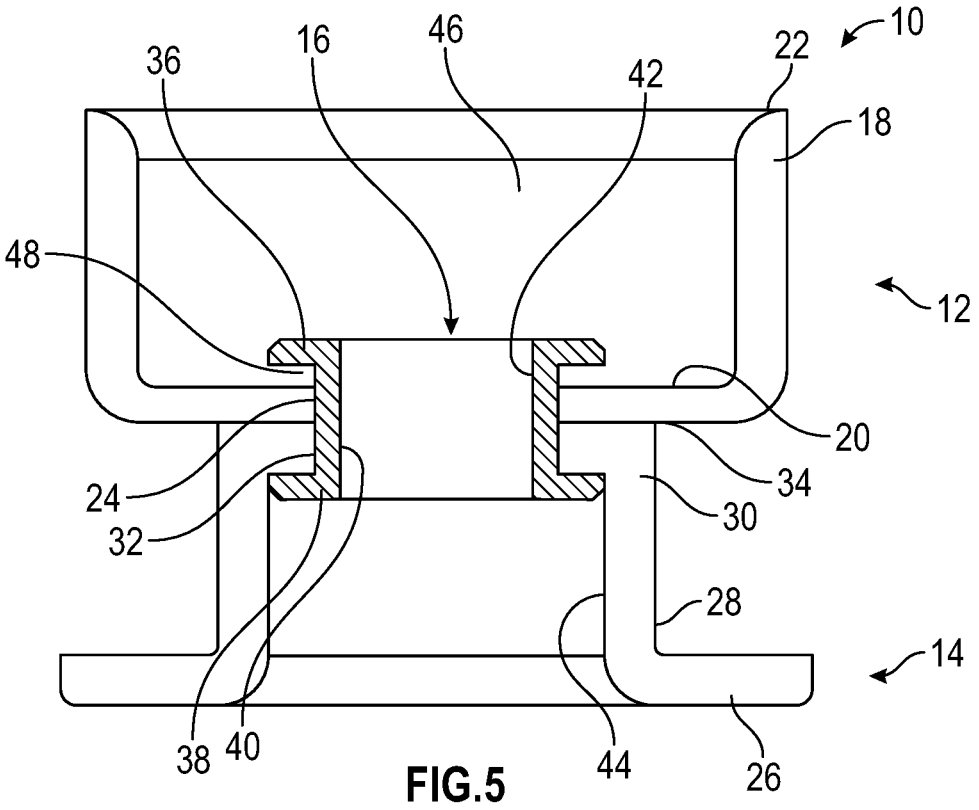
FIG. 5 depicts a side cross-sectional view of the three-piece primer insert used in polymer ammunition cases.

FIG. 5 depict a side, cross-sectional view of another embodiment of a three piece primer insert used in a polymeric cartridge case. The three piece primer insert 10 has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When overmolded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36.

Figure 6:
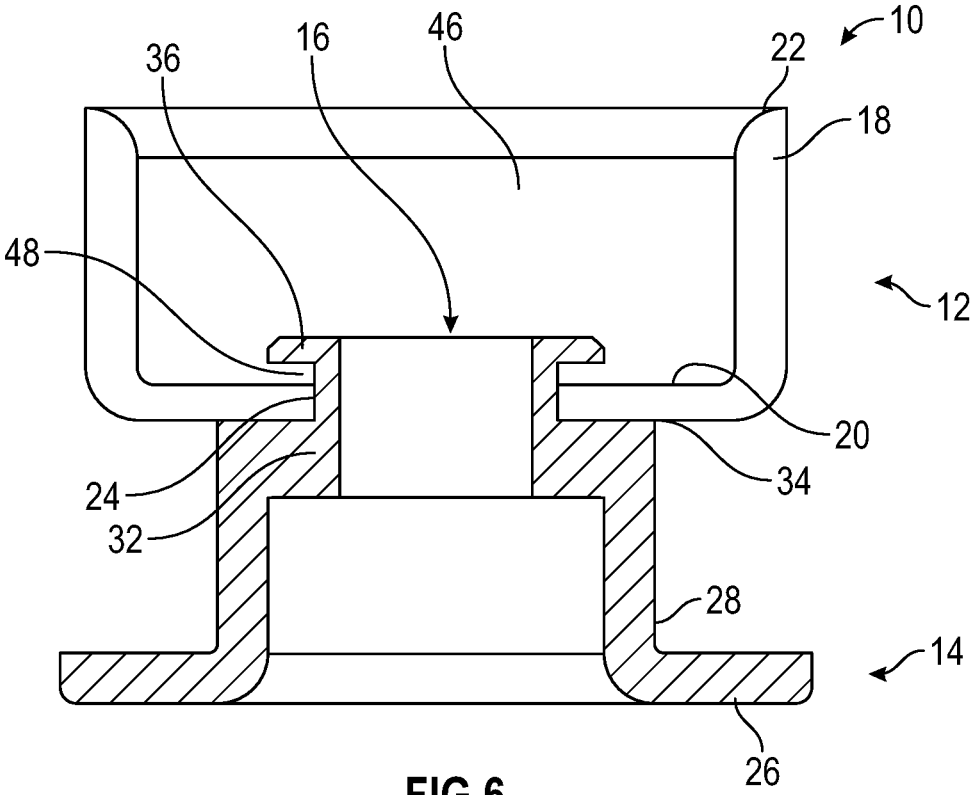
FIG. 6 depicts a side cross-sectional view of the three-piece primer insert used in polymer ammunition cases.

FIG. 6 depict a side, cross-sectional view of another embodiment of a primer insert used in a polymeric cartridge case. The three piece primer insert 10 has an upper primer insert portion 12 and a lower primer insert portion 14 wherein the connecting member 16 is integrated therein. The upper primer insert portion 12 includes a coupling element 18 that extends from the upper primer insert bottom portion 20 to the upper primer insert tip 22. The coupling element 18 is substantially cylindrical. The upper primer insert bottom portion 20 extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When overmolded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36.

Figure 7:
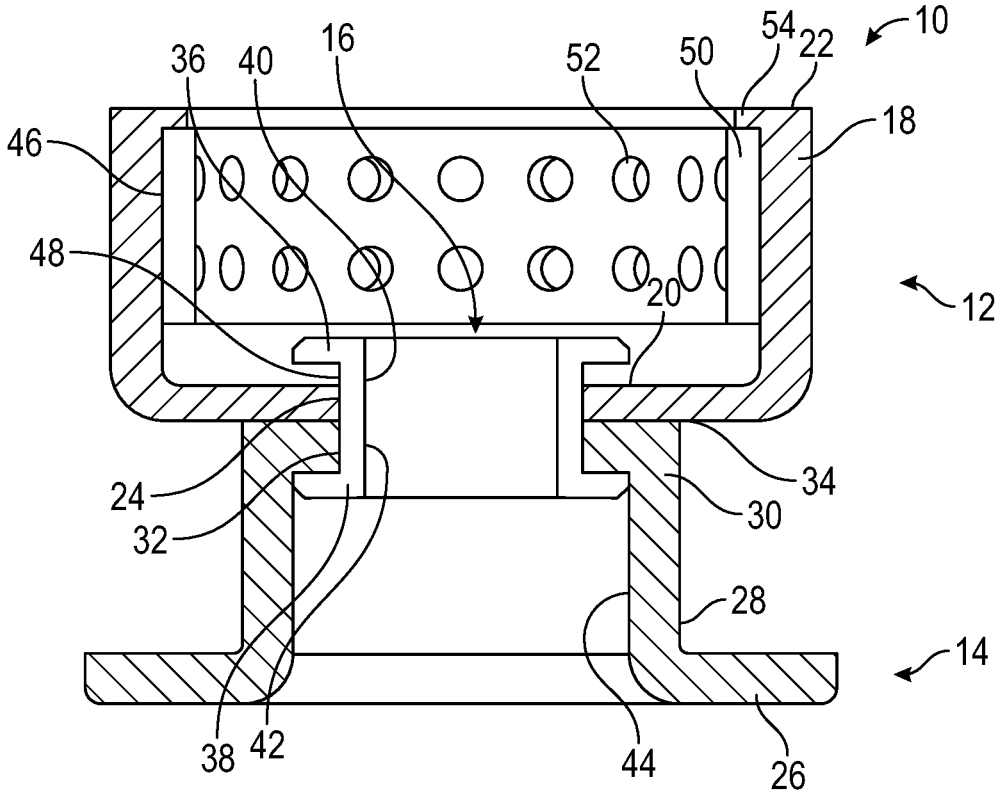
FIG. 7 depict a side, cross-sectional view of a three piece primer insert having a textured ring for use in a polymeric cartridge case.

FIG. 7 depict a side, cross-sectional view of a three piece primer insert having a textured ring for use in a polymeric cartridge case. The three piece primer insert 10 has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. A textured ring 50 is positioned in contact with the upper cup 46. The textured ring 50 may be positioned around the upper cup 46 or partially around the upper cup 46. In addition, the width of the textured ring 50 may be varied depending on the specific parameters. For example, the textured ring 50 may cover 100% to 5% of the surface area of the upper cup 46. Specifically, the textured ring 50 may cover about 0.5, 1, 2, 3, 4, 5, 15, 20, 25, 30, 35, 40, 45, 50, 60, 70, 80, 90, 99, or 100% of the surface area of the upper cup 46. This area may be related to the width of the textured ring 50, the height of the textured ring 50 or both. In addition, the thickness of the textured ring 50 may be varied as necessary from 0.001 to 1000 mm. The textured ring 50 may also include texturing on one or more walls of the textured ring 50. The texturing may take many forms from holes 52 through or partially through the textured ring 50. However, the texturing may be in the form of grooves, hatch, knurling, slots, lines, holes (circle, triangle, square, polygon, freeform shape, etc.) or other texturing. The hole 52 may be aligned in rows and regularly spaced. In some embodiments the rows align the holes bur in others the holes are offset. The holes and rows may be aligned, staggered, or randomly positioned. In addition, the texturing may go partially or entirely through the textured ring 50. For example, the textured ring 50 may include holes 52 that extend through the textured ring 50. The textured ring 50 may be made out of metals, metal alloys, plastic, polymers, ceramics. To affix the textured ring 50 to the upper cup 46 any mechanism may be used, e.g., pressing, molding, crimping, welding, melting, bonding, using solvent, adhesive, spin-welding, vibration-welding, ultrasonic-welding, laser-welding techniques or other methods known to the skilled artisan. In addition, the textured ring 50 may be placed in the upper cup 46 and a lip 56 used to hold the textured ring 50 in position. In some embodiments, multiple methods can be used to hold the textured ring 50 in position. For example, the textured ring 50 may be welded into place and a crimp lip 56 used to hold the textured ring 50 in position. Alternatively, the textured ring 50 may be pressed into the upper cup 46 and a crimp lip 56 crimped over the textured ring 50. As an alternative the textured ring 50 may be integrated into the upper cup 46 through molding or machining. When over-molded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46, over the textured ring 50 and extends into the channel 48. When the textured ring 50 includes texturing including holes 56 the overmolding extends into the texturing or holes 56. In some embodiments, the overmolding is flush with the top of the channel 48. In other embodiments, the overmolding is flush with the top of the upper tab 36. In other embodiments, the overmolding extends between the channel 48 and the top of the upper tab 36. Although the texturing is depicted as holes in a ring, the texturing may be directly on the insert surface in the forms of dimples, lines, grooves, knurling, etc.

Figure 8:
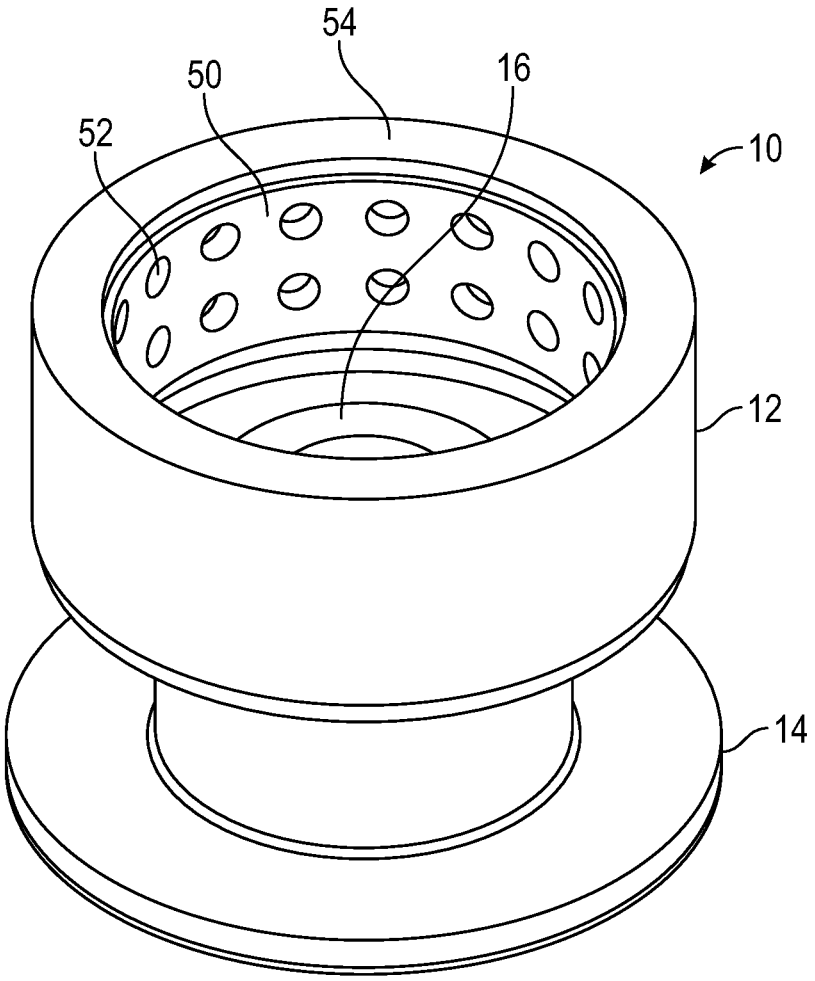
FIG. 8 depicts a prospective view of a three piece primer insert having a textured ring used in a polymeric cartridge case.

FIG. 8 depicts a prospective view of a three piece primer insert having a textured ring used in a polymeric cartridge case. The 3 piece primer insert 10 includes an upper primer portion 12 and a lower primer portion 14 connected by a connecting member 16. A textured ring 50 is placed in the upper cup (not shown), wherein the textured ring 50 includes holes 52 that extend through the textured ring 50 and a lip 56 used to hold the textured ring in position.

Figure 9:
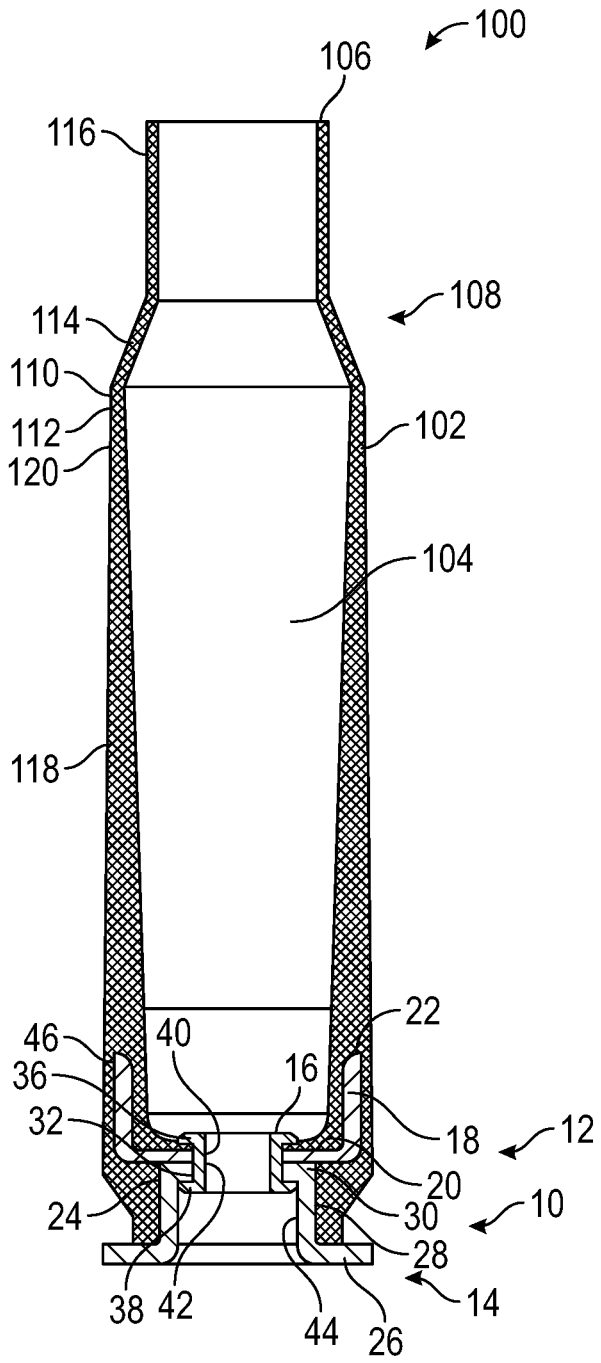
FIG. 9 depicts a side, cross-sectional view of a polymeric cartridge case according to one embodiment of the present invention.

FIG. 9 depicts a side, cross-sectional view of a portion of a polymeric cartridge case having a three piece primer insert. A cartridge 100 is shown manufactured with a polymer casing 102 showing a propellant chamber 104 with projectile aperture at the forward projectile aperture 106. The polymer casing 102 has a nose 108 extending from the projectile aperture 16 rearward to connection end 110. The nose 108 may be formed with the coupling end 112 formed on the connection end 110. The nose 108 has a shoulder 114 positioned between the connection end 110 and the projectile aperture 106, with a chamber neck 116 located from the projectile aperture 106 to the shoulder 114. The nose 108 typically has a wall thickness between about 0.003 and about 0.200 inches; more preferably between about 0.005 and about 0.150; and more preferably between about 0.010 and about inches. An optional first and second annular groove (cannelures) may be provided in the nose 108 in the interlock surface of the male coupling element to provide a snap-fit between the two components. The bullet is inserted into the casing to the depth to lock the bullet in its proper location. The nose 108 and middle body component 118 can then be welded, melted or bonded together using solvent, adhesive, spin-welding, vibration-welding, ultrasonic-welding or laser-welding techniques.

The middle body component 118 extends from a nose connection 120 to overmold a three piece primer insert 10 to form a propellant chamber 104. The three piece primer insert has an upper primer insert portion 12 and a lower primer insert portion 14 connected by a connecting member 16. The upper primer insert portion 12 includes a coupling element 18 that extends from the upper primer insert bottom portion 20 to the upper primer insert tip 22. The coupling element 18 is substantially cylindrical. The upper primer insert bottom portion 20 extend inwardly from the coupling element 18. An upper flash aperture 24 extends through the upper primer insert bottom portion 20. The lower primer insert portion 14 includes an extraction flange 26 connected to a side wall 28 that is connected to a lower insert portion connecting tab 30. A lower flash aperture 32 extends through the lower insert portion connecting tab 30. The upper primer insert portion 12 and the lower primer insert portion 14 meet the connection joint 34 to align the upper flash aperture 24 in the lower flash aperture 32. The connecting portion 16 includes an upper tab 36 connected to a lower tab 38 by a connecting member 40. The connecting portion 16 includes a flash aperture 42 that extends from the upper tab 36 to the lower tab 38, such that the connecting member 40 is the sidewall of the flash aperture 42. The upper primer insert portion 12 is aligned with the lower primer insert portion 14 such that the upper primer insert bottom portion 20 contacts the lower insert portion connecting tab 30 to align the upper flash aperture 24 in the lower flash aperture 32. The connecting portion 16 is then inserted into the upper flash after 24 in the lower flash aperture 32 so that the lower tab 38 contacts the lower insert portion connecting tab 30. The lower tab 38 now forms the bottom of the primer recess 44. The coupling element 18 forms and upper cup 46. The upper tab 36 extends into the upper cup 46. A channel 48 is formed between the bottom of the upper tab 36 and the upper primer insert bottom portion 20. With the upper flash aperture 24 and the lower flash aperture 32 aligned the connecting member 40 forms a flash aperture 42, that allows passage from the upper cup 46 to the primer recess 44. In addition, the upper primer insert portion 12 and the lower primer insert portion 14 may be independently joined by welding, melting, bonding, using solvent, adhesive, spin-welding, vibration-welding, ultrasonic-welding, laser-welding techniques or other methods known to the skilled artisan prior to the addition of the connecting member 16. When overmolded the coupling end (not shown) interlocks with the substantially cylindrical coupling element 18. The coupling element 18 extends to the upper primer insert tip 22. The upper primer insert tip 22 may be blunted, rounded, tapered, beveled, curved, etc. The upper primer insert tip 22 physical interlock to the middle body component (not shown). The overmolding extends over the upper primer insert tip 22 into the upper cup 46 and extends into the channel 48. In some embodiments, the overmolding is flush with the top of the channel 48. In other embodiments, the overmolding is flush with the top of the upper tab 36. In other embodiments, the overmolding extends between the channel 48 and the top of the upper tab 36. The middle body component extends from a projectile aperture 106 to the overmolded coupling end 22. The middle body component 118 typically has a wall thickness between about 0.003 and about 0.200 inches; and more preferably between about 0.005 and about 0.150 inches; and more preferably between about and about 0.050 inches. The projectile aperture 106, middle body component 118 and overmolded three piece primer insert 10 to define the interior of propellant chamber 104 in which the powder charge (not shown) is contained. The interior volume of the propellant chamber 104 may be varied to provide the volume necessary for complete filling of the chamber 104 by the propellant chosen so that a simplified volumetric measure of propellant can be utilized when loading the cartridge. Either a particulate or consolidated propellant can be used.

The projectile (not shown) is held in place within chamber case neck 116 at projectile aperture 106 by an interference fit. The projectile (not shown) may be inserted into place following the completion of the filling of propellant chamber 104. Mechanical means (e.g., welding, melting, bonding, bonding together using solvent, adhesive, spin-welding, vibration-welding, ultrasonic-welding or laser-welding techniques) can be used to hold the projectile (not shown) in the projectile aperture 106 can also be applied to increase the projectile pull force holding the projectile (not shown) in place. The projectile (not shown) can also be injection molded directly onto the projectile aperture 106 of the nose 108 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The nose 108 can be connected to the middle body component 118 at the nose connection 112 which can be welding, melting, bonding, bonding together using solvent, adhesive, spin-welding, vibration-welding, ultrasonic-welding or laser-welding techniques. The welding or bonding increases the joint strength at the cook-off temperature so the casing can be extracted from the hot gun casing after firing.

Chemical welding and chemical bonding involves the use of chemical compositions that undergoes a chemical or physical reaction resulting in the joining of the materials and the formation of a unitary primer insert. The chemicals may join the surfaces through the formation of a layer that contacts both surfaces or by melting the surfaces to a single interface between the surfaces.

Adhesive bonding involves the use of a polymeric adhesive, which undergoes a chemical or physical reaction, for eventual joint formation. The upper primer insert portion mates to the lower primer insert portion at the insert joint to which an adhesive material has been added to form a unitary primer insert. The adhesive includes high-strength and tough adhesives that can withstand both static and alternating loads.

Welding techniques including laser welding, ultrasonic welding, friction spot welding, and friction stir welding to connect the upper primer insert portion to the lower primer insert portion prior to the addition of the connecting member. The welding methods can use the existing materials to weld the upper primer insert portion to the lower primer insert portion or an additional material may be used to weld the upper primer insert portion to the lower primer insert portion. The dissimilar multi-metal welded unitary primer insert must be examined to determine the crack sensitivity, ductility, susceptibility to corrosion, etc. In some cases, it is necessary to use a third metal that is soluble with each metal in order to produce a successful joint.

The three piece primer insert used in polymeric cartridge cases includes an upper primer insert portion and a lower primer insert portion joined at an insert joint and connectby the connecting member. The individual upper primer insert portion and lower primer insert portion may be formed in various methods. For example the individual upper primer insert portion, the lower primer insert portion and the connecting member may be formed by metal injection molding, polymer injection molding, stamping, milling, molding, machining, punching, fine blanking, smelting, or any other method that will form insert portions that may be joined together to form a primer insert.

For example, the individual upper primer insert portion, the lower primer insert portion or both may be formed by fineblanking. Fineblanking is a specialty type of metal stamping that can achieve part characteristics such as flatness and a full sheared edge to a degree that is nearly impossible using a conventional metal cutting or punching process and is used to achieve flatness and cut edge characteristics that are unobtainable by conventional stamping and punching methods. When the punch makes contact with the sheet, the metal begins to deform and bulge around the point of the punch. As the yield strength of the part material is exceeded by the downward force of the press, the point of the punch begins to penetrate the metal's surface. Both the punch and matrix, or button, begin to cut from their respective sides. When the ultimate tensile strength has been reached, the metal breaks or fractures from the edge of the punch to the edge of the matrix. This results in a cut edge that appears to be partially cut and partially broken or fractured. This cut edge condition often is referred to as the "cut band." In most cases, the cut edge has about 10 percent to 30 percent of shear, and the remainder is fractured. The fracture has two primary causes. The distance between the punch and the matrix creates a leverage action and tends to pull the metal apart, causing it to rupture. The deformation that is allowed during the cutting process also allows the metal to fracture prematurely. Allowing the metal to deform severely during the cutting process results in straining of the metal, which in turn causes a stress. Trapped stresses in a product cause it to lose its flatness, which is why it is very difficult to maintain a critical flatness characteristic using conventional methods. Fineblanking requires the use of three very high-pressure pads in a special press. These pads hold the metal flat during the cutting process and keep the metal from plastically deforming during punch entry. Most fineblanking operations incorporate a V-ring into one of the high-pressure pads. This ring also is commonly referred to as a "stinger" or "impingement" ring. Before the punch contacts the part, the ring impales the metal, surrounds the perimeter of the part, and traps the metal from moving outward while pushing it inward toward the punch. This reduces rollover at the cut edge. Fineblanking operations usually require clearances of less than 0.0005 inch per side. This small clearance, combined with high pressure, results in a fully sheared part edge. Fineblanking is much like a cold extruding process. The slug (or part) is pushed or extruded out of the strip while it is held very tightly between the high-pressure holding plates and pads. The tight hold of the high-pressure plates prevents the metal from bulging or plastically deforming during the extrusion process.

For example, when the individual upper primer insert portion and lower primer insert portion or both are metal injection molded, the raw materials are metal powders and a thermoplastic binder. There are at least two Binders included in the blend, a primary binder and a secondary binder. This blended powder mix is worked into the plasticized binder at elevated temperature in a kneader or shear roll extruder. The intermediate product is the so-called feedstock. It is usually granulated with granule sizes of several millimeters. In metal injection molding, only the binders are heated up, and that is how the metal is carried into the mold cavity. In preparing a feedstock, it is important first to measure the actual density of each lot of both the metal powders and binders. This is extremely important especially for the metal powders in that each lot will be different based on the actual chemistry of that grade of powder. For example, 316L is comprised of several elements, such as Fe, Cr, Ni, Cu, Mo, P, Si, S and C. In order to be rightfully called a 316L, each of these elements must meet a minimum and maximum percentage weight requirement as called out in the relevant specification. Tables I-IV below provide other examples of the elemental compositions of some of the metal powders, feed stocks, metals, alloys and compositions of the present invention. Hence the variation in the chemistry within the specification results in a significant density variation within the acceptable composition range. Depending on the lot received from the powder producer, the density will vary depending on the actual chemistry received. In addition to the specific compositions listed herein, the skill artisan recognizes the elemental composition of common commercial designations used by feedstock manufacturers and processors, e.g., C-0000 Copper and Copper Alloys; CFTG-3806-K Diluted Bronze Bearings; CNZ-1818 Copper and Copper Alloys; CNZP-1816 Copper and Copper Alloys; CT-1000 Copper and Copper Alloys; CT-1000-K Bronze Bearings; CTG-1001-K Bronze Bearings; CTG-1004-K Bronze Bearings; CZ-1000 Copper and Copper Alloys; CZ-2000 Copper and Copper Alloys; CZ-3000 Copper and Copper Alloys; CZP-1002 Copper and Copper Alloys; CZP-2002 Copper and Copper Alloys; CZP-3002 Copper and Copper Alloys; F-0000 Iron and Carbon Steel; F-0000-K Iron and Iron-Carbon Bearings; F-0005 Iron and Carbon Steel; F-0005-K Iron and Iron-Carbon Bearings; F-0008 Iron and Carbon Steel; F-0008-K Iron and Iron-Carbon Bearings; FC-0200 Iron-Copper and Copper Steel; FC-0200-K Iron-Copper Bearings; FC-0205 Iron-Copper and Copper Steel; FC-0205-K Iron-Copper-Carbon Bearings; FC-0208 Iron-Copper and Copper Steel; FC-0208-K Iron-Copper-Carbon Bearings; FC-0505 Iron-Copper and Copper Steel; FC-0508 Iron-Copper and Copper Steel; FC-0508-K Iron-Copper-Carbon Bearings; FC-0808 Iron-Copper and Copper Steel; FC-1000 Iron-Copper and Copper Steel; FC-1000-K Iron-Copper Bearings; FC-2000-K Iron-Copper Bearings; FC-2008-K Iron-Copper-Carbon Bearings; FCTG-3604-K Diluted Bronze Bearings; FD-0200 Diffusion-Alloyed Steel; FD-0205 Diffusion-Alloyed Steel; FD-0208 Diffusion-Alloyed Steel; FD-0400 Diffusion-Alloyed Steel; FD-0405 Diffusion-Alloyed Steel; FD-0408 Diffusion-Alloyed Steel; FF-0000 Soft-Magnetic Alloys; FG-0303-K Iron-Graphite Bearings; FG-0308-K Iron-Graphite Bearings; FL-4005 Prealloyed Steel; FL-4205 Prealloyed Steel; FL-4400 Prealloyed Steel; FL-4405 Prealloyed Steel; FL-4605 Prealloyed Steel; FL-4805 Prealloyed Steel; FL-48105 Prealloyed Steel; FL-4905 Prealloyed Steel; FL-5208 Prealloyed Steel; FL-5305 Prealloyed Steel; FLC-4608 Sinter-Hardened Steel; FLC-4805 Sinter-Hardened Steel; FLC-48108 Sinter-Hardened Steel; FLC-4908 Sinter-Hardened Steel; FLC2-4808 Sinter-Hardened Steel; FLDN2-4908 Diffusion-Alloyed Steel; FLDN4C2-4905 Diffusion-Alloyed Steel; FLN-4205 Hybrid Low-Alloy Steel; FLN-48108 Sinter-Hardened Steel; FLN2-4400 Hybrid Low-Alloy Steel; FLN2-4405 Hybrid Low-Alloy Steel; FLN2-4408 Sinter-Hardened Steel; FLN2C-4005 Hybrid Low-Alloy Steel; FLN4-4400 Hybrid Low-Alloy Steel; FLN4-4405 Hybrid Low-Alloy Steel; FLN4-4408 Sinter Hardened Steel; FLN4C-4005 Hybrid Low-Alloy Steel; FLN6-4405 Hybrid Low-Alloy Steel; FLN6-4408 Sinter-Hardened Steel; FLNC-4405 Hybrid Low-Alloy Steel; FLNC-4408 Sinter-Hardened Steel; FN-0200 Iron-Nickel and Nickel Steel; FN-0205 Iron-Nickel and Nickel Steel; FN-0208 Iron-Nickel and Nickel Steel; FN-0405 Iron-Nickel and Nickel Steel; FN-0408 Iron-Nickel and Nickel Steel; FN-5000 Soft-Magnetic Alloys; FS-0300 Soft-Magnetic Alloys; FX-1000 Copper-Infiltrated Iron and Steel; FX-1005 Copper-Infiltrated Iron and Steel; FX-1008 Copper-Infiltrated Iron and Steel; FX-2000 Copper-Infiltrated Iron and Steel; FX-2005 Copper-Infiltrated Iron and Steel; FX-2008 Copper-Infiltrated Iron and Steel; FY-4500 Soft-Magnetic Alloys; FY-8000 Soft-Magnetic Alloys; P/F-1020 Carbon Steel PF; P/F-1040 Carbon Steel PF; P/F-1060 Carbon Steel PF; P/F-10C40 Copper Steel PF; P/F-10050 Copper Steel PF; P/F-10060 Copper Steel PF; P/F-1140 Carbon Steel PF; P/F-1160 Carbon Steel PF; P/F-11C40 Copper Steel PF; P/F-11050 Copper Steel PF; P/F-11060 Copper Steel PF; P/F-4220 Low-Alloy P/F-42XX Steel PF; P/F-4240 Low-Alloy P/F-42XX Steel PF; P/F-4260 Low-Alloy P/F-42XX Steel PF; P/F-4620 Low-Alloy P/F-46XX Steel PF; P/F-4640 Low-Alloy P/F-46XX Steel PF; P/F-4660 Low-Alloy P/F-46XX Steel PF; P/F-4680 Low-Alloy P/F-46XX Steel PF; SS-303L Stainless Steel—300 Series Alloy; SS-303N1 Stainless Steel—300 Series Alloy; SS-303N2 Stainless Steel—300 Series Alloy; SS-304H Stainless Steel—300 Series Alloy; SS-304L Stainless Steel—300 Series Alloy; SS-304N1 Stainless Steel—300 Series Alloy; SS-304N2 Stainless Steel—300 Series Alloy; SS-316H Stainless Steel—300 Series Alloy; SS-316L Stainless Steel—300 Series Alloy; SS-316N1 Stainless Steel—300 Series Alloy; SS-316N2 Stainless Steel—300 Series Alloy; SS-409L Stainless Steel—400 Series Alloy; SS-409LE Stainless Steel—400 Series Alloy; SS-410 Stainless Steel—400 Series Alloy; SS-410L Stainless Steel—400 Series Alloy; SS-430L Stainless Steel—400 Series Alloy; SS-430N2 Stainless Steel—400 Series Alloy; SS-434L Stainless Steel—400 Series Alloy; SS-434LCb Stainless Steel—400 Series Alloy; and SS-434N2 Stainless Steel—400 Series Alloy.

Parts are molded until they feel that the cavity has been filled. Both mold design factors such as runner and gate size, gate placement, venting and molding parameters set on the molding machine affect the molded part. A helium Pycnometer can determine if there are voids trapped inside the parts. During molding, you have a tool that can be used to measure the percent of theoretical density achieved on the "Green" or molded part. By crushing the measured "green" molded part back to powder, you can now confirm the percent of air (or voids) trapped in the molded part. To measure this, the density of the molded part should be measured in the helium Pycnometer and compared to the theoretical density of the feedstock. Then, take the same molded part that was used in the density test and crush it back to powder. If this granulate shows a density of more than 100% of that of the feedstock, then some of the primary binders have been lost during the molding process. The molding process needs to be corrected because using this process with a degraded feedstock will result in a larger shrinkage and result in a part smaller than that desired. It is vital to be sure that your molded parts are completely filled before continuing the manufacturing process for debinding and sintering. The helium Pycnometer provides this assurance. Primary debinding properly debound parts are extremely important to establish the correct sintering profile. The primary binder must be completely removed before attempting to start to remove the secondary binder as the secondary binder will travel through the pores created by the extraction of the primary binder. Primary debinding techniques depend on the feedstock type used to make the parts. However the feedstock supplier knows the amount of primary binders that have been added and should be removed before proceeding to the next process step. The feedstock supplier provides a minimum "brown density" that must be achieved before the parts can be moved into a furnace for final debinding and sintering. This minimum brown density will take into account that a small amount of the primary binder remnant may be present and could be removed by a suitable hold during secondary debinding and sintering. The sintering profile should be adjusted to remove the remaining small percent of primary binder before the removal of the secondary binder. Most external feedstock manufacturers provide only a weight loss percent that should be obtained to define suitable debinding. Solvent debound parts must be thoroughly dried, before the helium Pycnometer is used to determine the "brown" density so that the remnant solvent in the part does not affect the measured density value. When the feedstock manufacturer gives you the theoretical density of the "brown" or debound part, can validate the percent of debinding that has been achieved. Most Metal Injection Molding (MIM) operations today perform the secondary debinding and sintering in the same operation. Every MIM molder has gates and runners left over from molding their parts. So, you will be able to now re-use your gates and runners with confidence that they will shrink correctly after sintering. If the feedstock producers have given you the actual and theoretical densities of their feedstock, you can easily measure the densities of the gates and runners and compare the results to the values supplied. Once the regrind densities are higher than that required to maintain the part dimensions, the regrinds are no longer reusable.

Feedstock in accordance with the present invention may be prepared by blending the powdered metal with the binder and heating the blend to form a slurry. Uniform dispersion of the powdered metal in the slurry may be achieved by employing high shear mixing. The slurry may then be cooled to ambient temperature and then granulated to provide the feedstock for the metal injection molding.

As known to those of ordinary skill in the art, stainless steel is an alloy of iron and at least one other component that imparts corrosion resistance. As such, in one embodiment, the stainless steel is an alloy of iron and at least one of chromium, nickel, silicon, molybdenum, or mixtures thereof. Examples of such alloys include, but are not limited to, an alloy containing about 1.5 to about 2.5 percent nickel, no more than about 0.5 percent molybdenum, no more than about 0.15 percent carbon, and the balance iron with a density ranging from about 7 g/cm$^3$ to about 8 g/cm$^3$; an alloy containing about 6 to about 8 percent nickel, no more than about 0.5 percent molybdenum, no more than about 0.15 percent carbon, and the balance iron with a density ranging from about 7 g/cm$^3$ to about 8 g/cm$^3$; an alloy containing about 0.5 to about 1 percent chromium, about 0.5 percent to about 1 percent nickel, no more than about 0.5 percent molybdenum, no more than about 0.2 percent carbon, and the balance iron with a density ranging from about 7 g/cm$^3$ to about 8 g/cm$^3$; an alloy containing about 2 to about 3 percent nickel, no more than about 0.5 percent molybdenum, about 0.3 to about 0.6 percent carbon, and the balance iron with a density ranging from about 7 g/cm$^3$ to about 8 g/cm$^3$; an alloy containing about 6 to about 8 percent nickel, no more than about 0.5 percent molybdenum, about 0.2 to about 0.5 percent carbon, and the balance iron with a density ranging from about 7 g/cm$^3$ to about 8 g/cm$^3$; an alloy containing about 1 to about 1.6 percent chromium, about 0.5 percent or less nickel, no more than about 0.5 percent molybdenum, about 0.9 to about 1.2 percent carbon, and the balance iron with a density ranging from about 7 g/cm$^3$ to about 8 g/cm$^3$; and combinations thereof.

Suitable tungsten alloys include an alloy containing about 2.5 to about 3.5 percent nickel, about 0.5 percent to about 2.5 percent copper or iron, and the balance tungsten with a density ranging from about 17.5 g/cm$^3$ to about 18.5 g/cm$^3$; about 3 to about 4 percent nickel, about 94 percent tungsten, and the balance copper or iron with a density ranging from about 17.5 g/cm$^3$ to about 18.5 g/cm$^3$; and mixtures thereof.

The polymeric and composite casing components may be injection molded. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% relative humidity). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL® resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 weight percent, and preferably up to about 65 weight percent of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a PCPBT polymer material. One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The primer insert is used to give the polymer case a tough enough ridge design and includes a flange or extraction flange for the weapons extractor to grab and pull the case out the chamber of the gun. The extracting insert is made of 17-4 stainless steel that is hardened to 42-45 rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The components may be made of polymeric compositions, metals, ceramics, alloys, or combinations and mixtures thereof. In addition, the components may be mixed and matched with one or more components being made of different materials. For example, the middle body component may be polymeric; the bullet-end component may be polymeric; and a substantially cylindrical insert may be metal. Similarly, the middle body component may be polymeric; the bullet-end component may be metal; and a substantially cylindrical insert may be an alloy. The middle body component may be polymeric; the bullet-end component may be an alloy; and a substantially cylindrical insert may be an alloy. The middle body component; the bullet-end component; and/or the substantially cylindrical insert may be made of a metal that is formed by a metal injection molding process.

The molded substantially cylindrical insert is then bound to the middle body component. In the metal injection molding process of making the substantially cylindrical insert a mold is made in the shape of the substantially cylindrical insert including the desired profile of the primer recess. The substantially cylindrical insert includes a substantially cylindrical coupling element extending from a bottom surface that is opposite a top surface. Located in the top surface is a primer recess that extends toward the bottom surface. A primer flash hole is located in the substantially cylindrical insert and extends through the bottom surface into the powder chamber. The coupling end extends through the primer flash hole to form an aperture coating while retaining a passage from the top surface through the bottom surface and into the powder chamber to provides support and protection about the primer flash hole. When contacted the coupling end interlocks with the substantially cylindrical coupling element, through the coupling element that extends with a taper to a smaller diameter at the tip to form a physical interlock between substantially cylindrical insert and middle body component.

The three piece primer insert includes an individual upper primer insert portion, lower primer insert portion and connecting member formed in various methods. For example, the individual upper primer insert portion, lower primer insert portion and connecting member may be formed by metal injection molding, polymer injection molding, stamping, pressing, milling, molding, machining, punching, fine blanking, smelting, or any other method. The portion may be formed from any material, any metal, any alloy, any plastic, any polymer or any composition known to the skilled artisan or listed herein. The individual lower primer insert portion may be formed from any material, any metal, any alloy, any plastic, any polymer or any composition known to the skilled artisan or listed herein.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A multi-piece primer insert configured for use as a base in a polymer ammunition cartridge, the multi-piece insert comprising:

an upper primer insert having a cylindrical coupling element extending from a bottom surface to a tip and forming a cup, and an upper aperture defined through the bottom surface;

a lower primer insert engaged to the upper primer insert at an insert joint, the lower primer insert having a sidewall defining an internal primer recess, the sidewall extending from a connecting tab proximate the insert joint to an opposite end forming an extraction flange, and a lower aperture defined through the connecting tab and concentrically aligned with the upper aperture; and a connecting member configured to secure the upper primer insert to the lower primer insert, the connecting member having an upper tab extending into the upper primer insert about the upper aperture, the upper tab connected to a lower tab by a sleeve extending through and engaged with the upper aperture and the lower aperture to define a flash hole, wherein the lower tab engaged to the connecting tab forms a part of a top surface of the primer recess and the flash hole links the primer recess to the cup.

2. The multi-piece primer insert of claim 1, wherein the flash hole has a uniformed internal diameter extending from the primer recess into the cup.

3. The multi-piece primer insert of claim 1, wherein the upper aperture defines a first diameter and the lower aperture defines a second diameter which is greater than the first diameter.

4. The multi-piece primer insert of claim 3, wherein the lower tab abuts an inner edge of the connecting tab of the lower primer insert and is in contact with the bottom surface of the upper primer insert to form a portion of the insert joint.

5. The multi-piece primer insert of claim 1, further comprising a channel defined between the bottom surface of the upper primer insert and a bottom surface of the upper tab.

6. The multi-piece primer insert of claim 5, wherein the channel circumvolves an outer surface of the sleeve extending above the bottom surface of the upper primer insert.

7. The multi-piece primer insert of claim 5, wherein the channel is configured to receive polymer from a polymeric cartridge body of the polymer ammunition cartridge during a molding process.

8. The multi-piece primer insert of claim 7, wherein the polymer is molded to sit flush with a top surface of the upper tab and cover the cup to form a cartridge body bottom surface.

9. The multi-piece primer insert of claim 7, wherein the polymer is molded to sit flush with the bottom surface of the upper tab and cover the cup to form a cartridge body bottom surface.

10. The multi-piece primer insert of claim 7, wherein the cylindrical coupling element is configured to be over molded with the polymer during the molding process to define an inner molded cup region and an outer polymer body surface.

11. The multi-piece primer insert of claim 1, wherein the lower tab circumvolves a bottom surface of the connecting tab.

12. The multi-piece primer insert of claim 1, further comprising an adhesive applied to the insert joint.

13. The multi-piece primer insert of claim 1, wherein the upper primer insert and the lower primer insert are made from a metal.

14. The multi-piece primer insert of claim 13, wherein the upper primer insert and the lower primer insert are made from the same metal.

15. The multi-piece primer insert of claim 1, wherein the connecting member is made from a metal.

16. The multi-piece primer insert of claim 1, wherein the connecting member is integral with the lower primer insert.

17. An ammunition cartridge connected to a multi-piece metallic primer insert defining a base, the ammunition cartridge having a mouth configured to receive a projectile and opening into a cartridge body defining a propellant chamber, wherein the cartridge body opposite the mouth is configured to engage the multi-piece primer insert, the multi-piece metallic primer insert comprising:

an upper primer insert having a cylindrical coupling element extending from a bottom surface to a tip and forming a cup, and an upper aperture defined through the bottom surface;

a lower primer insert engaged to the upper primer insert at an insert joint, the lower primer insert having a sidewall defining an internal primer recess, the sidewall extending from a connecting tab proximate the insert joint to an opposite end forming an extraction flange, and a lower aperture defined through the connecting tab and aligned with the upper aperture; and a connecting member configured to secure the upper primer insert to the lower primer insert, the connecting member having an upper tab extending into the upper primer insert about the upper aperture, the upper tab connected to a lower tab by a sleeve extending through and engaged with the upper aperture and the lower aperture to define a flash hole, the lower tab engaged to the connecting tab, and wherein the flash hole links the primer recess to the cup.

18. The ammunition cartridge of claim 17, further comprising a channel formed between the upper tab of the connecting member and the bottom surface of the upper primer insert, wherein the cartridge body engaged to the multi-piece primer insert fills the channel to form a propellant chamber bottom surface.

19. The ammunition cartridge of claim 18, wherein a caliber of the ammunition cartridge is selected from the group consisting of .223, .243, .25-06, .270, .300, .308, .338, .30-30, .30-06, .45-70, .50-90, 50 caliber, 45 caliber, 380 caliber, 38 caliber, 5.56 mm, 6 mm, 6.8 mm, 7 mm, 7.62 mm, 8 mm, 9 mm, 10 mm, and 12.7 mm.

* * * * *